United States Patent [19]

Jaquet et al.

[11] 4,224,065

[45] Sep. 23, 1980

[54] ALUMINUM BASE ALLOY

[75] Inventors: Jean-Claude Jaquet, Schaffhausen, Switzerland; Manfred Heckler, Singen, Fed. Rep. of Germany; Heinrich Zoller, Aesch, Switzerland

[73] Assignee: Swiss Aluminium Ltd., Chippis, Switzerland

[21] Appl. No.: 33,856

[22] Filed: Apr. 27, 1979

[30] Foreign Application Priority Data

May 19, 1978 [CH] Switzerland ..... 5451/78

[51] Int. Cl.[3] ..... C22C 21/00; C22C 21/22

[52] U.S. Cl. ..... 75/139; 75/143; 75/148; 75/151; 148/11.5 A; 148/12.7 A; 148/32.5; 148/159

[58] Field of Search ..... 75/139, 143, 148, 151; 148/11.5 A, 12.7 A, 32.5, 159

[56] References Cited

U.S. PATENT DOCUMENTS

| | | | |
|---|---|---|---|
| 2,026,551 | 1/1936 | Fink | 75/1 |
| 2,459,492 | 1/1949 | Bradbury | 148/32.5 |
| 2,784,126 | 3/1957 | Criner | 148/32.5 |
| 2,915,391 | 12/1959 | Criner | 75/142 |
| 3,291,654 | 12/1966 | Foerster | 148/12.7 |
| 3,759,758 | 9/1973 | Hatano et al. | 148/159 |
| 3,935,007 | 1/1976 | Baba et al. | 75/142 |

FOREIGN PATENT DOCUMENTS

| | | | |
|---|---|---|---|
| 709527 | 5/1954 | United Kingdom | 75/139 |
| 872051 | 7/1961 | United Kingdom | 75/139 |
| 336361 | 5/1972 | U.S.S.R. | 75/139 |

*Primary Examiner*—L. Dewayne Rutledge
*Assistant Examiner*—Upendra Roy
*Attorney, Agent, or Firm*—Bachman and LaPointe

[57] ABSTRACT

An aluminum alloy of the AlCu type containing cadmium and manganese exhibits an optimum combination of strength, toughness and corrosion resistance. The alloy contains 4.0 to 5.0% copper, 0.1 to 0.2% cadmium and 0.2 to 1.0% manganese. The alloy is suitable for the production of high strength, tough and corrosion resistant extrusion products.

8 Claims, 2 Drawing Figures

ALUMINUM BASE ALLOY

BACKGROUND OF THE INVENTION

The invention concerns an aluminum alloy of AlCu basis containing cadmium and manganese as further additions, and concerns too the use of the said alloy.

Aluminum alloys of the AlCu type belong to the group of so called high strength aluminum alloys. Their main application is in aircraft construction. It has been known for some decades now that the addition of magnesium to AlCu alloys accelerates both natural aging and artificial aging and is therefore a method of improving the age hardening of such alloys. The magnesium addition also causes the strength level which can be reached by artificial or natural aging to be raised considerably. Furthermore, on artificial age hardening AlCu alloys containing Mg, instead of forming the $\theta''$ and $\theta'$ phases of the binary alloy, the more thermally stable magnesium containing intermediate phases S'' and S' are formed; this results in higher strength at elevated temperatures.

However, artificially aged magnesium containing AlCu alloys exhibit very poor toughness properties and pronounced susceptibility to intercrystalline corrosion and stress corrosion. A further disadvantage of AlCuMg alloys is their very poor formability, in particular the extrudability. This makes it impossible to manufacture complicated extruded sections.

Attempts have been made to replace magnesium by cadmium. For example from the patents CH-Pat. No. 318 523 and GB-Pat. No. 709 527 AlCuCd alloys are known with additions of magnesium, tin, manganese, iron, silicon, and further impurities, and additions of zinc, nickel, chromium, molybdenum, zirconium, beryllium, cerium, boron, titanium, silver and lead.

It is already known from the above mentioned patent CH-Pat. No. 318 523 that alloys of the AlCuCd type exhibit certain advantages over alloys of the AlCuMg type viz, (a) they can, for example, be hot worked by rolling, drawing or forging, without forming cracks.
(b) The deformation can be carried out at high speed.
(c) In the worked condition the AlCuCd alloys exhibit less anisotropy in their properties than alloys of the AlCuMg type.

From the literature mentioned one learns in general—even if to some extent by way of implication—that because of their mechanical properties such as:

(a) high strength,
(b) good formability,
(c) good corrosion properties, in particular resistance to stress corrosion and intercrystalline corrosion, AlCuCd alloys must be extremely good as alloys for construction purposes. In spite of this knowledge, AlCuCd alloys have, up to now, not been able to find use in practice as they did not adequately provide the solutions to the problems encountered in practice. This is due in particular to the fact that the combination of the three properties viz, strength, toughness and corrosion resistance was not, or only insufficiently, considered. Both of the above mentioned patents encompass such a variety of possible combinations of alloying elements and also such wide concentration limits that—except for the above general information—they do not teach the expert anything of any practical use. The inventors therefore set themselves the task of developing an alloy of the AlCuCd type which satisfies the highest demands made on construction alloys in terms of strength, toughness and corrosion resistance.

SUMMARY OF THE INVENTION

This object is achieved by way of the invention in that, besides the normal impurities, the alloy contains as alloying elements:

4.0 to 5.0% copper, preferably 4.4 to 4.7%
0.1 to 0.2% cadmium, preferably 0.13 to 0.17%
0.2 to 1.0% manganese, preferably 0.4 to 0.7% and at least one of the elements viz, zirconium 0.1 to 0.4%, preferably 0.17 to 0.22%
vanadium 0.1 to 0.2%, preferably 0.13 to 0.17%

The optimum combination of the three properties strength, toughness and corrosion resistance sought for is fully reached by the alloy composition of the invention.

Surprisingly, it turns out that the alloy of the invention exhibits further, extremely favorable properties, for example:

The alloy can also be extruded into complicated sections.
The alloy allows extrusion welds to be formed i.e. it is also suitable for the manufacture of tubes.
The alloy exhibits extremely good hot strength.
The alloy can be water quenched from the extrusion temperature and then, at a later point in time e.g. after machining, can be age hardened.

DETAILED DESCRIPTION

Figure 1:
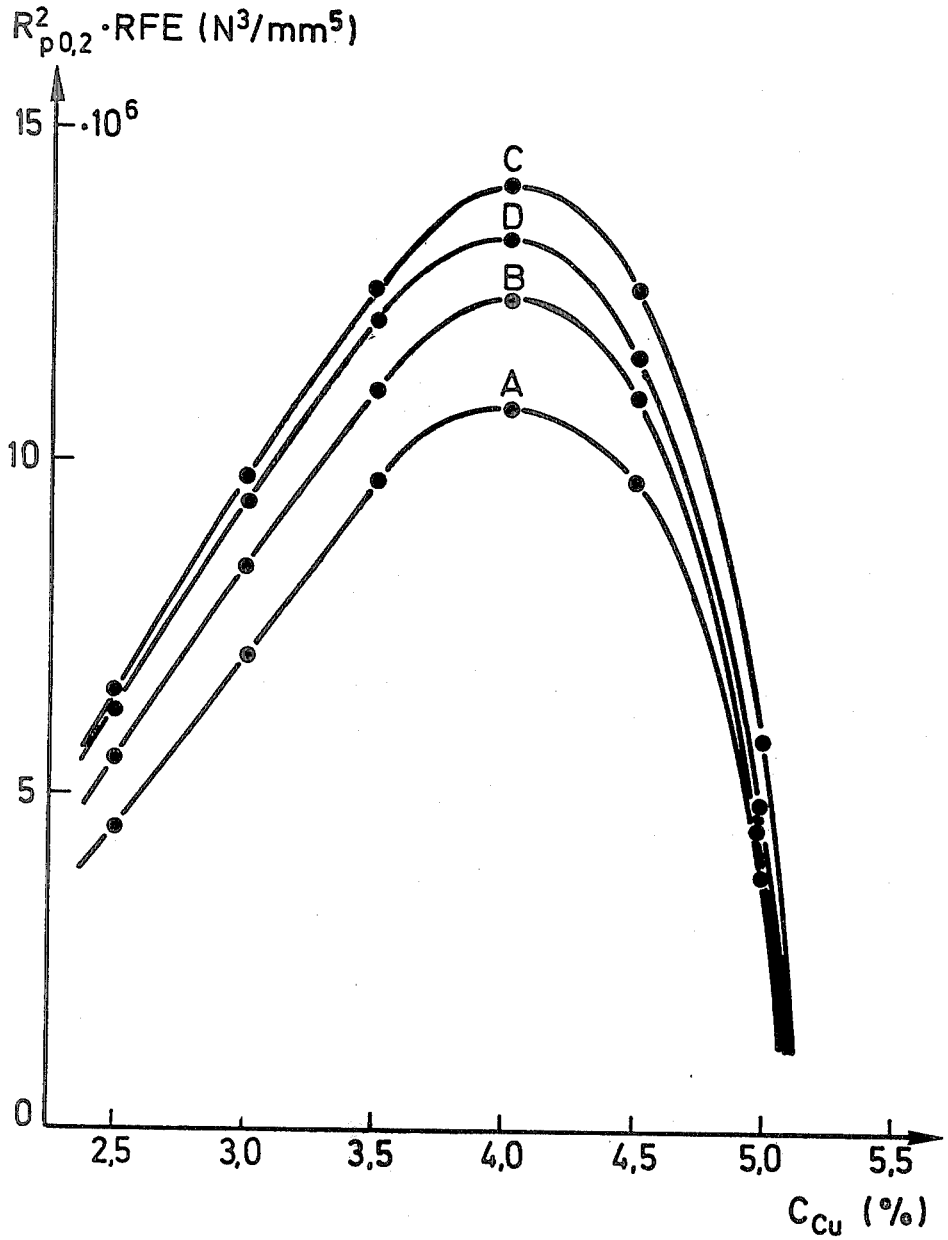
FIG. 1 is a graph showing properties of four different alloys with differing copper contents.

Of the known AlCu or AlCuMg alloys those with high hot strength exhibit either low strength at room temperature, for example AA 2219-T6, or low toughness e.g. AA 2618-T6. The alloy of the invention on the other hand exhibits both high strength at room temperature and high hot strength, and also good toughness. The alloy of the invention can be used above all in constructional parts which are highly stressed as for example occurs in aircraft constructions.

The evaluation of numerous trials with constructional parts made of aluminum alloys with copper as the main alloying element has led to the knowledge that, by introducing a material dependent construction factor $S_k$ in keeping with the equation $$S_k=(R_{p0.2})^A \cdot RFE,$$

where $R_{p0.2}$ is the 0.2% proof stress,
A is a weighting factor between 2 and 2.5 which relates to the construction, and
RFE is the crack propagation energy, a material can be characterized with respect to its suitability for highly stressed constructional parts. This empirical construction factor $S_k$ shows, in the case of the alloy of the invention, an extreme dependence on the copper content, and is likewise affected by the cadmium content. The maximum value of $S_k$ as a function of the copper content, representing the optimum combination of strength and toughness, lies at a copper content of about 4%. For economic reasons a copper content of less than 4% is of no interest as the time required for aging is too long. On the other hand, at a copper content of more than approx. 4.7% $S_k$ drops markedly. The practical, useful copper range lies therefore between 4 and 5%.

Raising the cadmium content likewise increases the strength of the alloy without decreasing the toughness; the upper cadmium limit of 0.2% is determined by the tendency towards hot tearing at high cadmium contents and by the marked diminution in corrosion resistance.

To achieve higher strength values, it has been found useful to limit both the iron and silicon contents to 0.5% max., preferably to 0.17%.

Strength and toughness—the latter expressed as the crack propagation energy—show a pronounced dependence on the temperature and duration of artificial aging. There is therefore the possibility to change, within certain limits, the combination of strength and toughness (expressed as the construction factor $S_k$ in terms of the above equation) by appropriate choice of temperature and duration of artificial ageing. Thermomechanical treatments play a role here too.

At a first approximation manganese, zirconium and vanadium have no effect on the strength. Manganese, zirconium and vanadium however increase the hot strength and creep resistance of the alloy of the invention. This is due to the thermally stable aluminides formed by the elements Mn, Zr and V. The particle diameter of these aluminides is between 0.1 and 1 μm. They increase the toughness very markedly in that they improve slip inside the grains and inhibit grain growth.

The alloy of the invention, like all alloys of the AlCu type, exhibits a certain susceptibility to pitting corrosion. The resistance to stress corrosion cracking depends greatly on the heat treatment given i.e. from the age hardening treatment. It was therefore found that the resistance to stress corrosion is also very satisfactory in the air cooled condition i.e. after slow cooling from the solution treatment temperature and artificial aging for 2 to 30 hours, preferably 15 to 26 hours at 170° to 195° C.

It is known that the extrudability of AlCu alloys, in particular AlCuMg alloys, is much poorer than that of the easily formable alloys such as, for example, AlZnMg alloys. It was therefore for the expert fully unexpected, when the alloy of the composition in keeping with the invention was found to exhibit a deformation behavior in terms of extrudability i.e. both in formability and resistance to deformation which is comparable with that of AlZnMg alloys.

This opens up a broad field of application for the alloy of the invention in areas utilizing highly stressed constructional parts. A further advantage over the known AlCu alloys lies in the possibility of extrusion welding, which—in combination with the good formability—permits the manufacture of complicated hollow sections via the extrusion process.

The advantages of the alloy of the invention will now be explained in greater detail with the help of four examples.

EXAMPLE NO. 1

Four series of alloys A, B, C and D with different copper contents in the range 2.0 to 5.5% were prepared keeping the concentrations of Cd, Mn and Zr constant in each of the series. The four series are listed in table I.

TABLE I

| | Cu | Cd | Mn | Zr |
|---|---|---|---|---|
| A | 2.0–5.5% | 0.05% | 0.50% | 0.20% |
| B | 2.0–5.5% | 0.10% | 0.50% | 0.20% |
| C | 2.0–5.5% | 0.15% | 0.50% | 0.20% |
| D | 2.0–5.5% | 0.15% | 0.10% | 0.10% |

The alloys were solution treated at 530° C. for 6 hours, quenched into water at room temperature and then artificially aged at 190° C. to maximum hardness.

FIG. 1 shows the dependence of the construction factor $$S_k = R_{p0.2}^2 \cdot RFE$$

on the copper content $C_{Cu}$ for the four series of alloys, all of which were artificially aged at 190° C. to maximum hardness.

It can be seen from FIG. 1 that at a constant copper content, increasing the concentration of cadmium, manganese and zirconium increases the $S_k$ factor. It is also clear that the maximum permissible copper content which provides a favorable combination of strength and toughness, lies at about 5%.

EXAMPLE NO. 2

Extrusion billets 216 mm in diameter and 410 mm in length were cast with an alloy composition in accordance with the invention, and in an alloy of the type AA 2017. The compositions of both alloys are given in table II. The billets were then extruded to a section of cross section 200 mm×4 mm.

TABLE II

| | Cu | Cd | Mg | Mn | Zr |
|---|---|---|---|---|---|
| Alloy acc. to invention | 4.5% | 0.15% | | 0.50% | 0.20% |
| AA 2017 | 4.1% | | 0.5% | 0.5% | |

The billet temperature was 410° C. for both compositions.

While the alloy in keeping with the invention could be extruded without problem with an extrusion force of 225 bar—the exit speed of the section was 5 m/min—the alloy AA 2017 could not be extruded, in spite of raising the applied force to 270 bar.

EXAMPLE NO. 3

The hot strength and creep resistance of an alloy of the invention with the composition given in Table II were measured with the material in the heat treated T6 condition.

For this the conventional testing of the 0.2% proof stress $R_{p0.2}^{1000h}$ after 1000 hours at the testing temperature, and the creep fracture strength $R_m^{1000h}$ after 1000 hours of loading at the testing temperature were measured.

Values for the alloys AA 7075-T6 and AA 2618-T6 were taken from the technical literature for comparison purposes.

The results are presented in tables III and IV.

TABLE III

| | $R_{p0.2}^{1000h}$ (N/mm²) | | |
|---|---|---|---|
| | 150° C. | 200° C. | 250° C. |
| AA 2618 - T6 | 320 | 220 | 180 |
| AA 7075 - T6 | 270 | 150 | 80 |
| Alloy acc. to | | | |

TABLE III-continued

| | $R_{p0.2}{}^{1000/h}$ (N/mm²) | | |
|---|---|---|---|
| | 150° C. | 200° C. | 250° C. |
| invention | 340 | 200 | 160 |

TABLE IV

| | $R_m{}^{1000/h}$ (N/mm²) | | |
|---|---|---|---|
| | 150° C. | 200° C. | 250° C. |
| AA 2618 - T6 | 250 | 140 | 80 |
| AA 7075 - T6 | 170 | 60 | 40 |
| Alloy acc. to invention | 250 | 150 | 100 |

EXAMPLE NO. 4

Three versions of the heat treatment condition T6 (as shown in table V) were carried out on an alloy of the invention with the composition given in table II.

TABLE V

| | Artificial age hardening |
|---|---|
| a | 175° C./8 h |
| b | 190° C./8 h |
| c | 160° C./48 h |

A known stress corrosion test with elastically bent samples was then carried out with the material which had been heat treated this way. The load applied during the test was in each case $0.75 \times R_{p0.2}$.

Figure 2:
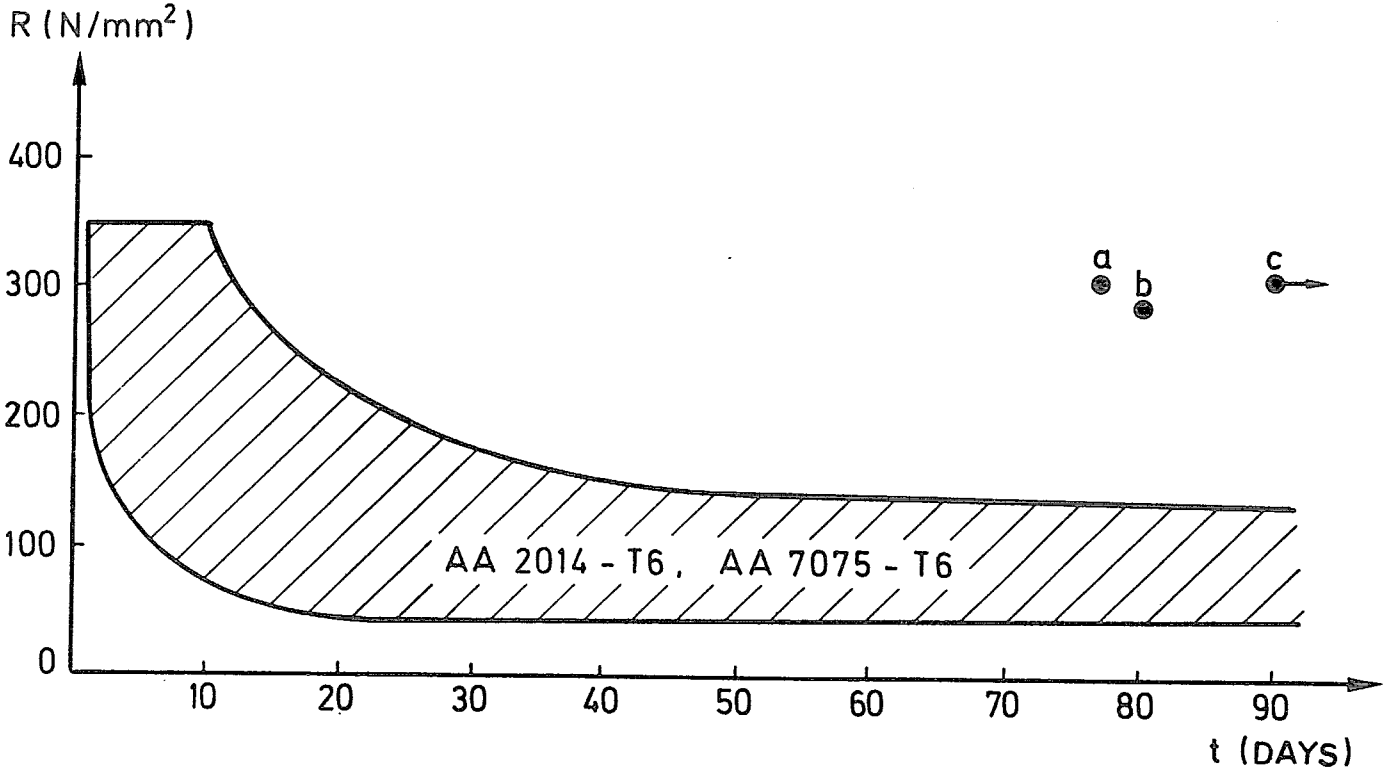
FIG. 2 is a graph illustrating the stress corrosion properties in days as a function of an applied load.

FIG. 2 shows the lifetime (in days) reached by the samples as a function of the applied load $0.75 \times R_{p0.2}$. Each point represents the average of 10 samples; an arrow indicates that no fracture occurred after the maximum test period of 90 days.

For comparison, the range of scatter for the alloys AA 7075-T6 and AA 2014-T6, obtained from technical literature, is also shown (applied load R).

It can be seen clearly in FIG. 2 that the alloy of the invention exhibits greater resistance to stress corrosion cracking than the alloys AA 7075 and AA 2014.

What is claimed is:

1. An aluminum base alloy having a good combination of strength, toughness and corrosion resistance consisting of from 4.0 to 5.0% copper, from 0.1 to 0.2% cadmium, from 0.2 to 1.0% manganese, a material selected from the group consisting of from 0.1 to 0.4% zirconium, from 0.1 to 0.2% vanadium and mixtures thereof, and the balance aluminum.

2. An alloy according to claim 1 wherein said alloy contains from 4.4 to 4.7% copper, from 0.13 to 0.17% cadmium and from 0.4 to 0.7% manganese.

3. An alloy according to claim 1 containing 0.5% max. each of iron and silicon.

4. An alloy according to claim 1 containing thermally stable aluminides formed by the elements manganese, zirconium and vanadium.

5. Extruded products having a composition as defined in claim 1 characterized by high strength, toughness and corrosion resistance.

6. An alloy according to claim 2 wherein said zirconium content is from 0.17 to 0.22% and wherein said vanadium content is from 0.13 to 0.17%.

7. An alloy according to claim 3 containing 0.17% max. each of iron and silicon.

8. An alloy according to claim 4 wherein said aluminides have a particle diameter between 0.1 and 1 μm.

* * * * *